US007962074B2

(12) United States Patent
Fukuyama et al.

(10) Patent No.: US 7,962,074 B2
(45) Date of Patent: Jun. 14, 2011

(54) DEVELOPING UNIT, IMAGE FORMING APPARATUS, AND FLOATING DEVELOPER COLLECTING METHOD FOR DEVELOPING UNIT

(75) Inventors: Hirotaka Fukuyama, Shizuoka (JP); Satoshi Itaya, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 152 days.

(21) Appl. No.: 12/372,001

(22) Filed: Feb. 17, 2009

(65) Prior Publication Data

US 2009/0208254 A1 Aug. 20, 2009

Related U.S. Application Data

(60) Provisional application No. 61/029,877, filed on Feb. 19, 2008, provisional application No. 61/039,771, filed on Mar. 26, 2008.

(51) Int. Cl.
*G03G 15/09* (2006.01)
*G03G 21/20* (2006.01)

(52) U.S. Cl. ..... 399/273; 399/92

(58) Field of Classification Search ..... 399/92, 399/98, 99, 264, 273, 283
See application file for complete search history.

(56) References Cited

U.S. PATENT DOCUMENTS

| | | | | |
|---|---|---|---|---|
| 4,361,396 | A * | 11/1982 | Uchida | 399/92 |
| 5,283,617 | A * | 2/1994 | Benedict et al. | 399/264 |
| 5,387,967 | A * | 2/1995 | Brewington et al. | 399/273 X |
| 6,067,428 | A * | 5/2000 | Zirilli et al. | 399/92 |
| 7,043,172 | B2 * | 5/2006 | Koshimura et al. | 399/99 |
| 7,221,898 | B2 * | 5/2007 | Pozniakas | 399/92 X |
| 7,289,747 | B2 * | 10/2007 | Miyamoto et al. | 399/92 |
| 7,447,462 | B2 * | 11/2008 | Nishimura et al. | 399/92 |
| 7,620,342 | B2 * | 11/2009 | Sata | 399/92 |

FOREIGN PATENT DOCUMENTS

| | | |
|---|---|---|
| JP | 04-056975 | 2/1992 |
| JP | 2003-029522 | 1/2003 |

* cited by examiner

*Primary Examiner* — Sandra L Brase
(74) *Attorney, Agent, or Firm* — Turocy & Watson, LLP

(57) ABSTRACT

A suction duct that sucks air is provided downstream from a magnet roller that applies a developer to a photoconductor while rotating, in a direction of rotation of the photoconductor, and upstream of a surface potential sensor that measures surface potential of the photoconductor. Moreover, ribs for adjusting an air flow are arranged within the suction duct in such a manner that a width of an air flow passage formed by a rear end in a direction of air flow and a forward end of a nearest rib in the direction of air flow is narrowed from a rib installed upstream in the direction of air flow toward a rib installed downstream. The collection duct collects a floating developer by using a negative pressure.

20 Claims, 6 Drawing Sheets

DEVELOPING UNIT, IMAGE FORMING APPARATUS, AND FLOATING DEVELOPER COLLECTING METHOD FOR DEVELOPING UNIT

CROSS-REFERENCE TO RELATED APPLICATION

This application is based upon and claims the benefit of priority from the prior U.S. patent application Ser. No. 61/029,877, filed on 19 Feb. 2008, and the prior U.S. patent application Ser. No. 61/039,771, filed on 26 Mar. 2008, the entire contents of which are incorporated herein by reference.

TECHNICAL FIELD

The present invention relates to an image forming apparatus such as a copy machine or printer, and particularly to a developing unit with improved capability of collecting a floating developer, an image forming apparatus, and a floating developer collecting method for a developing unit.

BACKGROUND

An image forming apparatus such as a copy machine or printer has a developing unit that casts a laser beam onto a charged photoconductor and applies a developer to a site where electric potential is changed. To maintain the electric potential of the photoconductor at a constant level, a surface potential sensor that measures the potential of the photoconductor is provided.

Conventionally, the surface potential sensor is installed upstream from a developing section, which is the position coated with the developer by the developing unit, in the direction of rotation of the photoconductor. Therefore, as a urethane seal in weak contact with the photoconductor is arranged between the surface potential sensor and the developing section, a floating developer can be prevented from attaching to the surface potential sensor.

However, if the laser unit is miniaturized in order to miniaturize the image forming apparatus, a long optical path length cannot be provided for the laser. Consequently, the surface potential sensor must be installed downstream from the developing section in the direction of rotation of the photoconductor.

If the surface potential sensor is installed downstream from the developing section in the direction of rotation of the photoconductor, the urethane seal cannot be arranged in weak contact with the photoconductor since the photoconductor is already coated with the developer at the position of the installation.

With respect to this point, a technique of providing a suction duct that collects a floating developer by a negative pressure, downstream from a developing section of an image forming apparatus in the direction of rotation of a photoconductor, is proposed (see, for example, JP-A-2003-29522) Also, a technique of blowing air from a blow duct and thus preventing floating toner from attaching to a surface potential sensor is proposed (see, for example, JP-A-4-56975).

However, if the duct is miniaturized in order to further miniaturize the image forming apparatus, places having strong and weak air flows are generated. This causes a problem that the floating developer cannot be collected efficiently.

SUMMARY

It is an object of the invention to provide an image forming apparatus and a floating developer collecting method with improved floating developer collection efficiency.

According to an aspect of the invention, an image forming apparatus includes: a recording medium supply mechanism that supplies recording media one by one; a recording medium carrying mechanism that carries the recording medium supplied by the recording medium supply mechanism to a recording medium discharge unit; an image forming unit that is arranged upstream from the recording medium discharge unit, in the recording medium carrying mechanism, and that executes an image forming process to print an image based on image data onto the recording medium carried by the recording medium carrying mechanism; and a developing unit that applies a developer to a photoconductor. The developing unit includes: a magnet roller that applies the developer to the photoconductor while rotating; a collection roller that collects the developer scattered from the rotating magnet roller; and a suction duct that has plural ribs therein for adjusting an air flow and collects the developer by a negative pressure. The ribs are arranged in such a manner that a width of an air flow passage formed by a rear end in a direction of air flow and a forward end of a nearest rib in the direction of air flow is narrowed from a rib installed upstream in the direction of air flow toward a rib installed downstream.

DETAILED DESCRIPTION

Throughout this description, the embodiments and examples shown should be considered as exemplars, rather than limitations on the apparatus and method of the invention.

Hereinafter, an embodiment of an image forming apparatus and a floating developer collecting method for an image forming apparatus according to the invention will be described in detail with reference to the drawings.

Outline of Image Forming Apparatus

Figure 1:
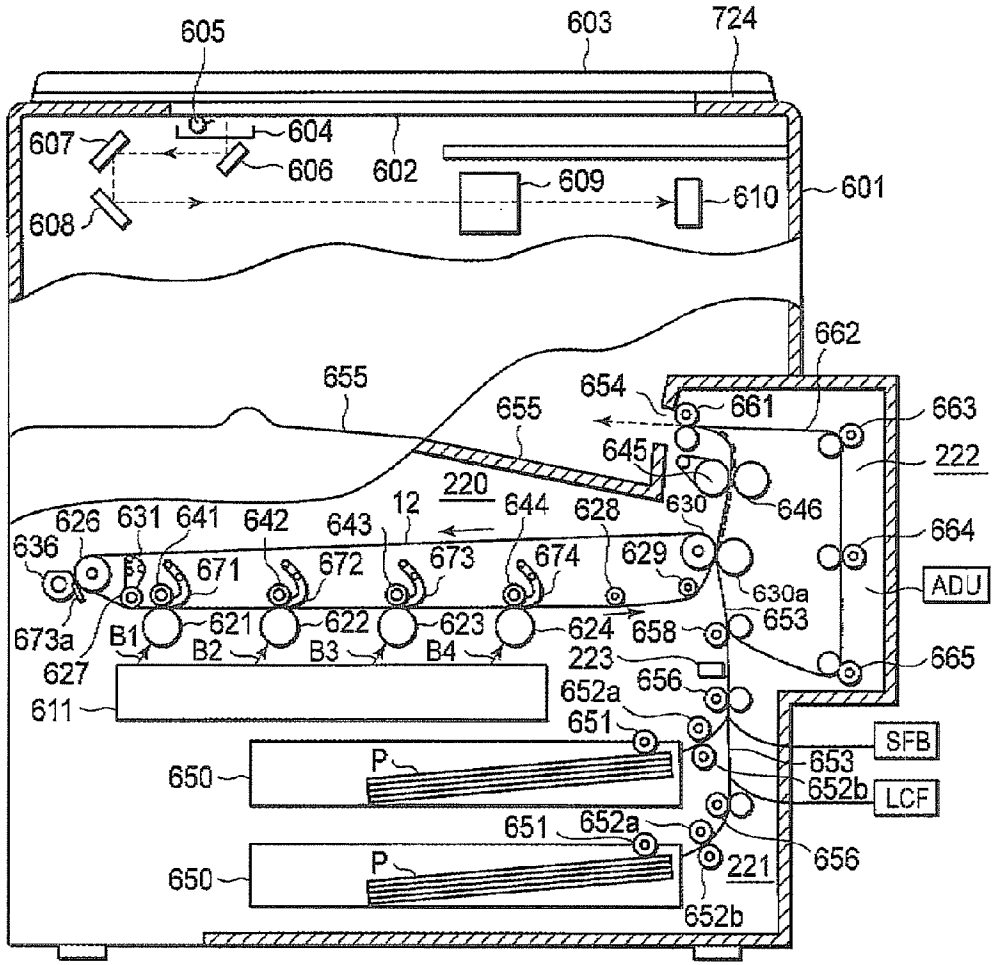
FIG. 1 shows an exemplary configuration of an image forming apparatus.

FIG. 1 shows an exemplary configuration of an image forming apparatus. As shown in FIG. 1, on top of an apparatus body 601, a document table 602 for setting a document thereon, made of a transparent material such as a glass plate, is provided. To cover this document table 602, a cover 603 is installed in an openable and closable manner on the apparatus body 601.

On the lower side of the document table 602 within the apparatus body 601, a scanning unit (not shown) is provided which optically scans an image of an original document set on the document table 602. For example, this scanning unit has a carriage 604, reflection mirrors 606, 607 and 608 that reflect light of an exposure lamp 605 reflected by the original document, a variable-power lens block 609 that varies magnification of the reflected light, and a CCD (charged coupled device) 610. The carriage 604 has the exposure lamp 605 that casts light toward the document table 602. The carriage 604 is configured to be capable of reciprocating along the lower side of the document table 602.

The carriage 604 reciprocates while lighting the exposure lamp 605, thereby exposing light to the original document set on the document table 602. A reflection light image of the original document set on the document table 602, formed by this exposure, is projected to the CCD 610 via the reflection mirrors 606, 607 and 608 and the variable-power lens block 609. The CCD 610 outputs image data corresponding to the projected reflection light image of the original document.

An image forming unit 220 is provided below the scanning unit within the apparatus body 601. The image forming unit 220 has, for example, a print engine (not shown) and a process unit (not shown).

The print engine includes an exposure unit 611. The process unit includes photoconductive drums 621, 622, 623 and 624 arranged along the exposure unit 611, an endless transfer belt 12 arranged to face the exposure unit 611 with the photoconductive drums 621, 622, 623 and 624 provided between them, a drive roller 626 that drives the transfer belt 12, primary transfer rollers 641, 642, 643 and 644 arranged to face the photoconductive drums 621, 622, 623 and 624 with the transfer belt 12 provided between them, and a transfer roller driving unit that drives the primary transfer rollers 641, 642, 643 and 644.

The transfer belt 12 is laid across the drive roller 626, guide rollers 627, 628 and 629, and a driven roller 630, and is turned counterclockwise by the power from the drive roller 626. The guide roller 627 is provided to be capable of moving up and down and is moved toward the transfer belt 12 by the rotation of a cam 631. Thus, the guide roller 627 displaces the transfer belt 12 toward the photoconductive drums 621, 622, 623 and 624.

This image forming unit 220 executes an image forming process to form an image based on image data (an image signal outputted from the CCD 610) and then to print the image onto a recording medium which is being carried. That is, an image signal outputted from the CCD 610 is properly processed and then supplied to the exposure unit 611. The exposure unit 611 emits a laser beam B1 corresponding to a yellow image signal to the photoconductive drum 621 for yellow, a laser beam B2 corresponding to a magenta image signal to the photoconductive drum 622 for magenta, a laser beam B3 corresponding to a cyan image signal to the photoconductive drum 623 for cyan, and a laser beam B4 corresponding to a black image signal to the photoconductive drum 624 for black.

The primary transfer rollers 641, 642, 643 and 644 are moved (lowered) toward the transfer belt 12 and thereby bring the transfer belt 12 into contact with the photoconductive drums 621, 622, 623 and 624. Thus, visible images on the photoconductive drums 621, 622, 623 and 624 are transferred to the transfer belt 12.

In the periphery of the photoconductive drum 621, a drum cleaner, a neutralizing lamp, a charging unit and a developing unit, not shown, are arranged in order. The drum cleaner has a drum cleaning blade that contacts the surface of the photoconductive drum 621, and scrapes off the remaining developer on the surface of the photoconductive drum 621 by the drum cleaning blade.

The neutralizing lamp eliminates electric charges remaining on the surface of the photoconductive drum 621. The charging unit applies a high voltage to the photoconductive drum 621 and thereby charges the surface of the photoconductive drum 621 with electrostatic charges. The charged surface of the photoconductive drum 621 is irradiated with the laser beam B1 emitted from the exposure unit 611. By this irradiation, an electrostatic latent image is formed on the surface of the photoconductive drum 621. The developing unit T1 supplies a yellow developer (toner) to the surface of the photoconductive drum 621 and thereby visualizes the electrostatic latent image on the surface of the photoconductive drum 621.

As for the other photoconductive drums 622, 623 and 624, electrostatic latent images on the surface of the photoconductive drums 622, 623 and 624 are similarly visualized using the developers of the corresponding colors.

At a position facing the drive roller 626 in the image forming unit 220, a cleaner 636 is provided with the transfer belt 12 nipped between them. This cleaner 636 has a cleaning blade 673*a* that contacts the transfer belt 12, and scrapes off the remaining developer on the transfer belt 12 by the cleaning blade 673*a*.

The print mode can be changed as follows. Hooks 671, 672, 673 and 674 are provided near the primary transfer rollers 641, 642, 643 and 644. These hooks 671, 672, 673 and 674 become engaged with the shafts of the primary transfer rollers 641, 642, 643 and 644 while rotating, and thus lift their shafts. Thus, the primary transfer rollers 641, 642, 643 and 644 moved away from the photoconductive drums 621, 622, 623 and 624. The print mode such as full-color mode, full-space mode, or monochrome mode can be changed by moving none of the primary transfer rollers 641, 642, 643 and 644, or by changing their combination when moving the primary transfer rollers 641, 642, 643 and 644.

Next, a housing mechanism and a supply mechanism for recording media will be described. Plural recording medium cassettes 650 that house recording media are provided below the exposure unit 611. In these recording medium cassettes 650, multiple recording media P of different recording medium types are housed in a stacked state. At an exit part (the right side in the drawing) of each of these recording media cassettes 650, a recording medium supply mechanism 221 is provided which supplies recording media in the recording medium cassette 650 one by one from the top. By this recording medium supply mechanism 221, the recording media P are taken out one by one from one of the recording medium cassettes 650. The recording medium supply mechanism 221 for taking out the medium includes a pickup roller 651, a recording medium supply roller 652*a*, and a separation roller 652*b*. The recording medium supply mechanism 221 separates the recording media P taken out from the recording medium cassette 650, one by one, and supplies each recording medium to a recording medium carrying mechanism 653.

Next, the carrying path of the recording medium will be described. The recording medium carrying mechanism 653 extends to a recording medium discharge port 654 in an upper part via the driven roller 630 of the image forming unit 220. The recording medium discharge port 654 faces a recording medium discharge unit 655 connected to the outer circumferential surface of the apparatus body 601. At the starting end of the carrying path 653, a carrying roller 656 is provided near each recording medium supply mechanism 221. When a recording medium is supplied by one of the recording medium supply mechanisms 221, the recording medium carrying mechanism 653 carries the supplied recording medium to the recording medium discharge unit 655.

A secondary transfer roller 630*a* is provided at the position facing the driven roller 630 with the transfer belt 12 nipped between them, in a halfway part of the recording medium carrying mechanism 653. A registration roller 658 is provided at a position before the driven roller 630 and the secondary transfer roller 630*a* in the carrying direction.

The registration roller 658 inserts the recording medium P between the transfer belt 12 and the secondary transfer roller 630*a* in timing synchronized with transfer operation by the transfer belt 12 and the secondary transfer roller 630*a* to transfer an image formed by a developer (toner) to the recording medium. The secondary transfer roller 630*a*, nips the recording medium P inserted from the registration roller 658 together with the transfer belt 12 on the driven roller 630, transfers to the recording medium P a visible image formed by the developer (toner) transferred to the transfer belt 12, and then prints the image. In this manner, the registration roller 658 carries the recording medium P to the image forming unit 220 having the transfer belt 12 and the secondary transfer roller 630*a* synchronously with the transfer operation in the image forming unit 220.

At a position downstream from the secondary transfer roller 630*a* in the recording medium carrying mechanism 653, a heat fixing device for heat fixation is provided. The heat fixing device has a metal roller, a fixing roller 645, a fixing belt laid across the metal roller and the fixing roller, and a pressurizing roller 646 that is abutted against the fixing roller 645 with the fixing belt provided between them. The pressurizing roller 646 has a heating device such as a heater lamp provided therein.

The recording medium P with the developer transferred thereto is nipped between the fixing roller 645 and the pressurizing roller 646 and is heated and pressurized while being carried. At this time, the developer becomes fixed to the recording medium P. At the terminal end of the recording medium carrying mechanism 653, a recording medium discharge roller 661 is provided.

An automatic double-side unit (hereinafter referred to as ADU) 222 may be provided in the apparatus body 601. The ADU 222 is installed to connect a sub-carrying path 662, which is a path for carrying the recording medium P in the ADU 222, to the terminal end of the recording medium carrying mechanism 653 and the entry to the registration roller 658. The sub-carrying path 662 is branched from the downstream side of the recording medium carrying mechanism 653 with respect to the image forming unit 220 (from the terminal end of the recording medium carrying mechanism 653) and merges into the upstream side of the recording medium carrying mechanism 653 with respect to the image forming unit 220 (to an upstream position from the registration roller 658).

This sub-carrying path 662 reverses the sides of the recording medium P for double-side print. Recording medium supply rollers 663, 664 and 665 are provided in the sub-carrying path 662. The ADU 222 delivers the recording medium P carried from the image forming unit 220 to the recording medium discharge unit 655, into the opposite direction, and carries the recording medium P through the sub-carrying path 662, thus causing the recording medium to merge into the recording medium carrying mechanism 653 on the upstream side of the image forming unit 220. As the recording medium P is carried in this way, the sides of the recording medium P are reversed.

After merging into the recording medium carrying mechanism 653, the recording medium P returned to the upstream side of the image forming unit 220 by the sub-carrying path 662 is sent by the registration roller 658 to the transfer position where the transfer belt 12 and the secondary transfer roller 630*a* contact each other, synchronously with the transfer operation in the image forming unit 220. Thus, a visible image on the transfer belt 12 is transferred to and printed on the back side of the recording medium P as well.

If double-side print is designated by a computer or the like connected to the apparatus body 601 via a operation panel 724 provided in the apparatus body 601 or via a network, the sub-carrying path 662 of the ADU 222 enters the state of actuation to reverse the sides of the recording medium P.

Next, additional devices to be provided will be described. In the example of the apparatus body 601 shown in FIG. 1, two recording medium cassettes 650 are provided as recording medium supply sources. However, three or more recording medium cassettes 650 may be provided in the apparatus body 601. Moreover, though not shown, a recording medium supply mechanism for manual insertion (hereinafter referred to as SFB) or a large-capacity supply recording medium feeder (hereinafter referred to as LCF), which is a recording medium supply mechanism capable of housing thousands of recording media in a stacked state, can also be provided. These SFB and LCF are installed in the apparatus body 601 in such a manner that their paths of supplying the recording medium merge into the recording medium carrying mechanism 653.

A recording medium type sensor 223 may also be provided in the apparatus body 601. The recording medium type sensor 223 is provided at a position that is on the upstream side of the recording medium carrying mechanism 653 with respect to the image forming unit 220 and that is upstream from the registration roller 658. The recording medium type sensor 223 detects the recording medium type of the recording medium P carried by the recording medium carrying mechanism 653. For the recording medium type sensor 223, a known sensor can be used which determines the type of the recording medium P, for example, by detecting the thickness or light transmittance of the recording medium P.

If an SFB or LCF is installed, the recording medium type sensor 223 is arranged downstream from the merging point of the recording medium supply path from the SFB or LCF and the recording medium carrying mechanism 653. With such arrangement, the type of the recording medium P carried from any of the recording medium supply sources to the recording medium carrying mechanism 653 can be detected by the single recording medium type sensor 223.

Developing Unit

Figure 2:
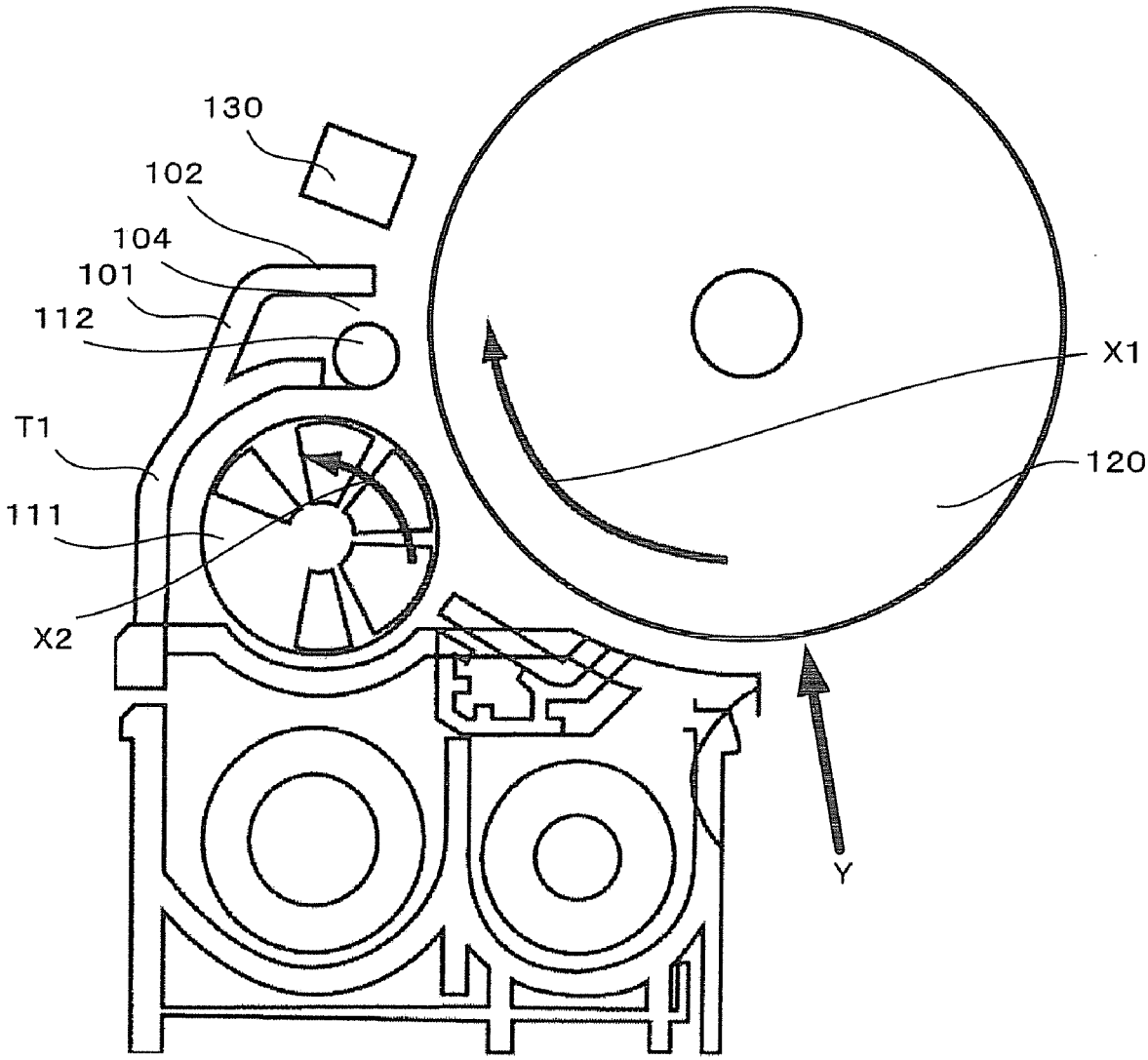
FIG. 2 is a sectional side view of a developing unit.

FIG. 2 is a sectional side view of the developing unit T1. As shown in FIG. 2, the developing unit T1 has a magnet roller 111 that applies a developer to a photoconductor 120 while rotating, a collection roller 112 that collects the developer scattered from the rotating magnet roller 111, and a suction duct 101 that sucks and collects the floating developer by negative pressures.

The suction duct 101 has a duct cover 102 that covers the suction duct 101. A suction port 104 for sucking the floating developer, provided in the suction duct 101, is opened toward the collection roller 112. The height of the suction port 104 is higher than the upper end of the collection roller 112 in the direction of rotation X1 of the photoconductor 120. Therefore, even the floating developer that cannot be collected by the collection roller 112 can be sucked and collected.

The suction duct 101 is installed upstream from a surface potential sensor 130 in the direction of rotation X1 of the photoconductor 120. That is, the magnet roller 111, the collection roller 112, the suction duct 101 and the surface potential sensor 130 are arranged in this order from a laser irradiation position Y toward downstream in the direction of rotation X1 of the photoconductor 120. Thus, the suction duct can suck the floating developer before the floating developer adheres to the surface potential sensor 130.

The magnet roller 111 rotates in the direction from the laser irradiation site Y toward the collection roller 112, that is, in the direction of arrow X2. The photoconductor 120 rotates in the opposite direction of the rotation of the magnet roller 111, that is, in the direction of arrow X1.

Figure 3:
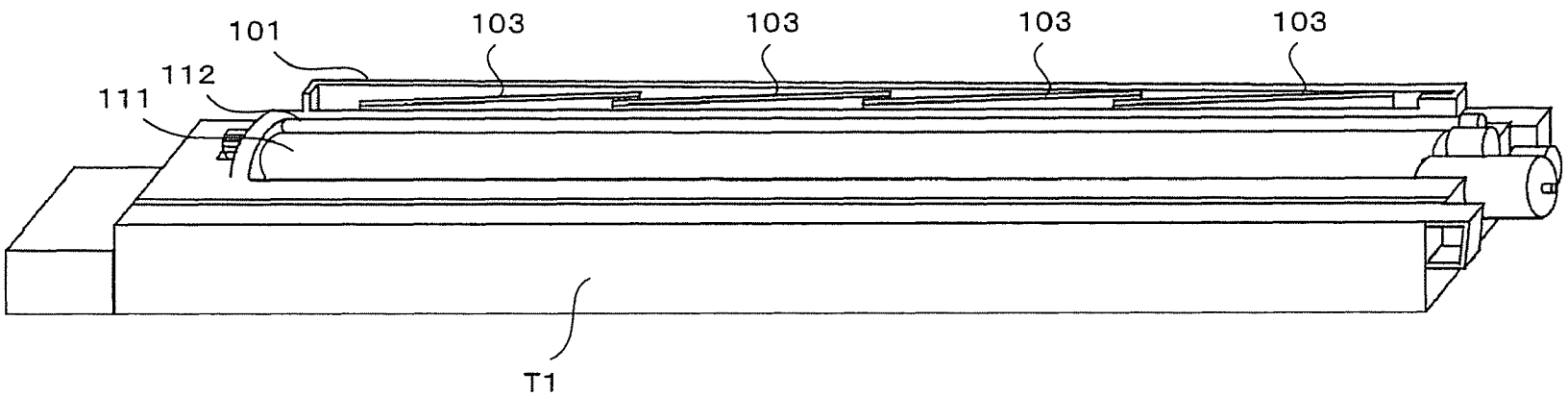
FIG. 3 is a perspective view of the developing unit.

FIG. 3 is a perspective view of the developing unit T1. The duct cover 102 is not shown in FIG. 3. As shown in FIG. 3, the suction duct 101 has plural ribs 103 provided therein which adjust air flows. The ribs 103 are in the form of plate and provided on the bottom surface of the suction duct 101. Their height reached the duct cover 102. Therefore, no air flows in from above and below the ribs 103.

The number of ribs 103 is not particularly limited. In FIG. 3, the suction duct 101 has four ribs 103. The ribs 103 are arranged at a certain angle to the longitudinal axis of the collection roller 112.

Figure 4:
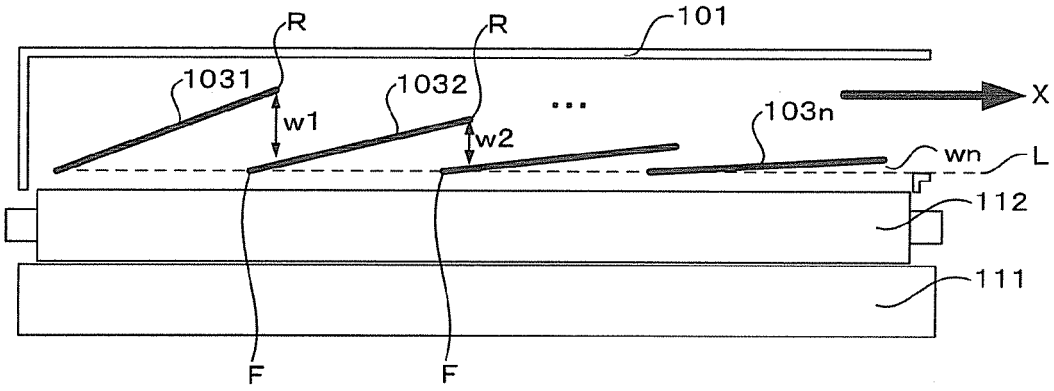
FIG. 4 is a top view showing the width of an air flow passage between ribs in a suction duct.

FIG. 4 is a top view showing the width of an air flow passage between the ribs 103 in the suction duct 101. In FIG. 4, the ribs 103 are shown as n ribs 1031 to 103n. As shown in FIG. 4, the ribs 1031 to 103n are arranged in such a manner that the width of an air flow passage formed by a rear end R in the direction of air flow of one rib and a forward end F in the direction of air flow of the nearest rib becomes narrower from the rib 1031 installed upstream in the direction of air flow X toward the rib 103n installed downstream. That is, the ribs 1031 to 103n are arranged to hold the relation of w1>w2> . . . >wn.

Figure 5:
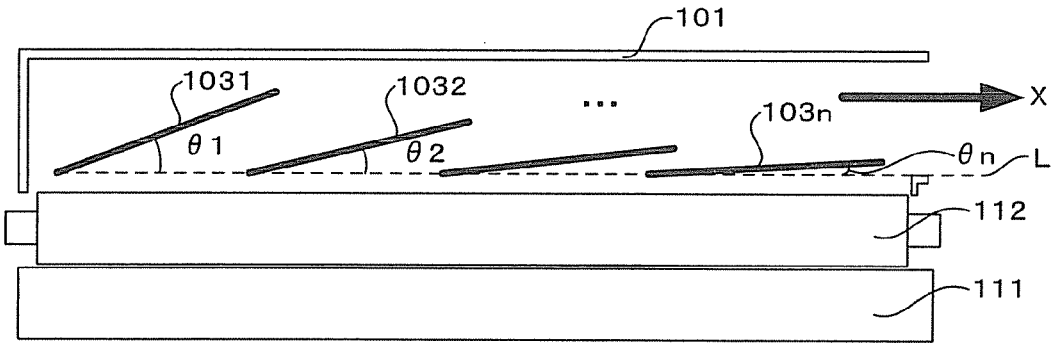
FIG. 5 is a top view showing the angle of ribs in the suction duct.

FIG. 5 is a top view showing the angle of the ribs 103 in the suction duct 101. As shown in FIG. 5, the ribs 1031 to 103n are arranged in such a manner that the angle formed by each rib and a reference line L becomes smaller from the rib 1031 installed upstream in the direction of air flow X toward the rib 103n installed downstream. That is, the ribs 1031 to 103n are arranged to hold the relation of θ1>θ2> . . . >θn.

Here, the reference line L is a straight line that is parallel to the longitudinal axis of the collection roller 112 and passes through the forward end of the ribs 103.

Figure 6A:
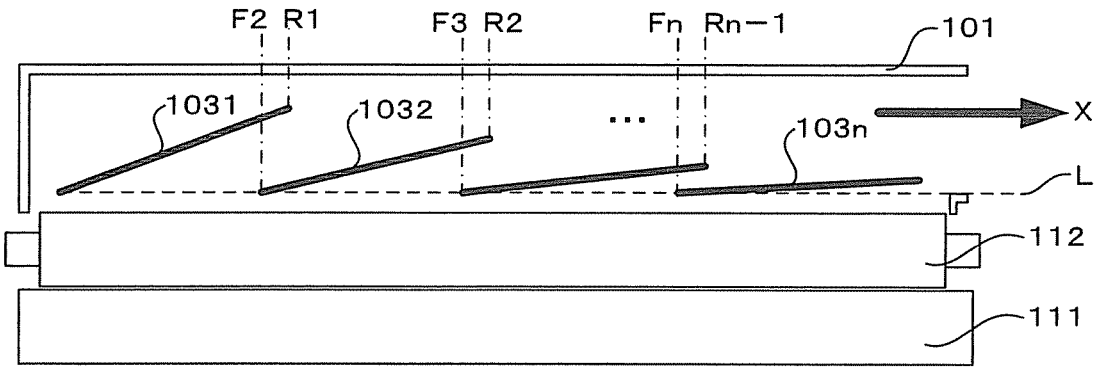
FIG. 6A is a top view showing a layout of ribs in the suction duct.

FIG. 6A is a top view showing a layout of the ribs 103 in the suction duct 101. As shown in FIG. 6A, the ribs 103 are arranged in such a manner that the rear end in the direction of air flow of each rib 103 is situated downstream in the direction of air flow X from the forward end in the direction of air flow of the nearest downstream rib 103 in the direction of air flow X.

As for the rib 1031 and the rib 1032, these ribs are arranged in such a manner that the rear end R1 in the direction of air flow of the rib 1031 is situated downstream in the direction of air flow X from the forward end F2 in the direction of air flow of the nearest downstream rib 1032 in the direction of air flow X.

As for the rib 103n−1 and the rib 103n, these ribs are arranged in such a manner that the rear end Rn−1 in the direction of air flow of the rib 103n−1 is situated downstream in the direction of air flow X from the forward end Fn in the direction of air flow of the nearest downstream rib 103n in the direction of air flow X.

Figure 6B:
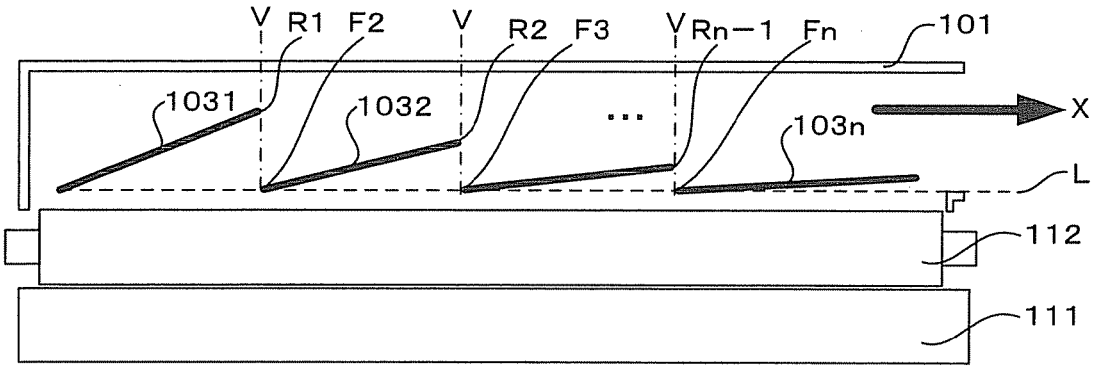
FIG. 6B is a top view showing a layout of ribs in the suction duct.

FIG. 6B is a top view showing a layout of the ribs 103 in the suction duct 101. As shown in FIG. 6B, the rear end in the direction of air flow of each rib 103 may be arranged in phase with the forward end in the direction of air flow of the nearest downstream rib 103 in the direction of air flow X.

Here, "in phase" means that the rear end in the direction of air flow of each rib 103 and the forward end in the direction of air flow of the nearest downstream rib 103 in the direction of air flow X are situated on the same line V perpendicular to the reference line L.

As for the rib 1031 and the rib 1032, these ribs are arranged in such a manner that the rear end R1 in the direction of air flow of the rib 1031 and the forward end F2 in the direction of air flow of the nearest downstream rib 1032 in the direction of air flow X are situated on the same line V perpendicular to the reference line L, that is, arranged in phase.

As for the rib 103n−1 and the rib 103n, these ribs are arranged in such a manner that the rear end Rn−1 in the direction of air flow of the rib 103n−1 and the forward end Fn in the direction of air flow of the nearest downstream rib 103n in the direction of air flow X are situated on the same line V perpendicular to the reference line L, that is, arranged in phase.

As described above, in the image forming apparatus according to this embodiment, the suction duct 101 of the developing unit T1 has the plural ribs 103 provided therein, and these ribs 103 are arranged in such a manner that the width of the air flow passage between the nearest ribs becomes narrower from the rib 1031 installed upstream in the direction of air flow X toward the rib 103n installed downstream.

Thus, there is an advantage that the suction force does not significantly vary irrespective of the position in the suction duct 101 and therefore the floating developer can be efficiently collected.

Installation Position of Surface Potential Sensor

Figure 7:
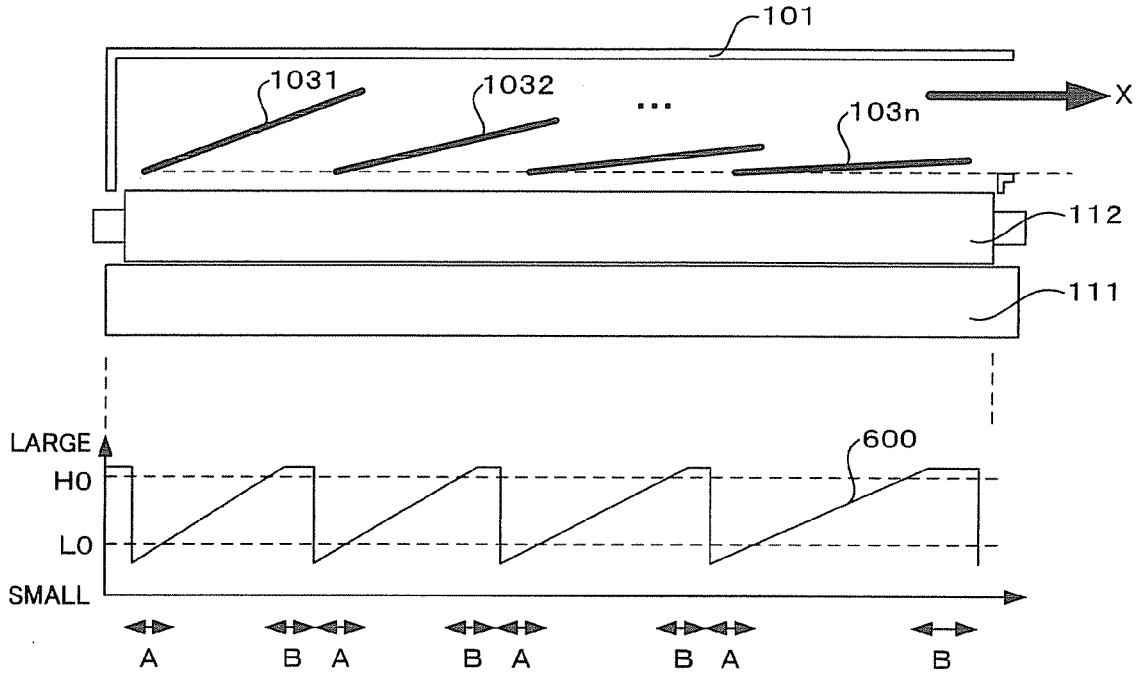
FIG. 7 is a top view of the suction duct showing the grounding position of a surface potential sensor.

FIG. 7 is a top view of the suction duct 101 showing the grounding position of the surface potential sensor 130. A graph 600 shows the relation between the position in the suction duct 101 and the suction force. The horizontal axis represents the position in the lateral direction of the suction duct 101. The vertical axis represents the suction force.

As shown in FIG. 7, the suction force in the suction duct 101 is large near the entry, which is the position where the ribs 103 overlap each other. The suction force becomes weaker as it is away from this position.

It is desirable that the surface potential sensor 130 should be installed at a position B where the suction force is greater than a first threshold value H0. It is also desirable that the surface potential sensor 130 should not be installed at a position A where the suction force is lower than a second threshold value L0. Here, it is assumed that the first threshold value H0 represents a greater suction force than the second threshold value L0.

As described above, in the image forming apparatus according to the embodiment, the surface potential sensor 130 is installed at a position where the suction force in the suction duct 101 exceeds a threshold value. This has an advantage that the suction duct 101 can efficiently prevent stain on the surface potential sensor 130 due to attachment of the floating developer.

Although exemplary embodiments of the invention have been shown and described, it will be apparent to those having ordinary skills in the art that a number of changes, modifications, or alterations to the invention as described herein may be made, none of which departs from the spirit of the invention. All such changes, modifications, and alterations should therefore be seen as within the scope of the invention.

What is claimed is:

1. A developing unit comprising:

a magnet roller that applies a developer to a photoconductor while rotating;

a collection roller that collects the developer scattered from the rotating magnet roller; and a suction duct that has plural ribs therein to adjust an air flow and collect the developer by a negative pressure; a distance of the two ribs which are selected from the plural ribs and disposed to be adjacent each other being narrower at the lower position along the direction of the air flow the distance of the two ribs being defined by the width between the rear end of one rib and the front end of another rib.

2. The unit according to claim 1, wherein the plural ribs are arranged in such a manner that an angle formed by each rib and a reference line parallel to a longitudinal axis of the collection roller and passing through the forward end in the direction of air flow of he rib becomes smaller from the rib installed upstream in the direction of air flow toward the rib installed downstream.

3. The unit according to claim 1, wherein the rear end in the direction of air flow of one rib is arranged to be situated downstream in the direction of air flow from or in phase with the forward end in the direction of air flow of another rib that is the nearest and downstream in the direction of air flow.

4. The unit according to claim 1, wherein a suction port of the suction duct is arranged between a surface potential sensor that measures a surface potential of the photoconductor and the magnet roller.

5. The unit according to claim 1, wherein a suction port of the suction duct is opened toward the collection roller.

6. The unit according to claim 1, wherein a suction port of the suction duct has a height higher than an upper end of the collection roller in the direction of rotation of the photoconductor.

7. An image forming apparatus comprising:

a recording medium supply mechanism that supplies recording media one by one; a recording medium carrying mechanism that carries the recording medium supplied by the recording medium supply mechanism to a recording medium discharge unit;

an image forming unit that is arranged upstream from the recording medium discharge unit, in the recording medium carrying mechanism, and that executes an image forming process to print an image based on image data onto the recording medium carried by the recording medium carrying mechanism; and a developing unit that applies a developer to a photoconductor, the developing unit comprising:

a magnet roller that applies the developer to the photoconductor while rotating;

a collection roller that collects the developer scattered from the rotating magnet roller; and a suction duct that has plural ribs therein to adjust an air flow and collect the developer by a negative pressure; a distance of the two ribs which are selected from the plural ribs and disposed to be adjacent each other being narrower at the lower position along the direction of the air flow the distance of the two ribs being defined by the width between the rear end of one rib and the front end of another rib.

8. The apparatus according to claim 7, wherein the ribs are arranged in such a manner that an angle formed by each rib and a reference line parallel to a longitudinal axis of the collection roller and passing through the forward end in the direction of air flow of he rib becomes smaller from the rib installed upstream in the direction of air flow toward the rib installed downstream.

9. The apparatus according to claim 7, wherein the rear end in the direction of air flow of one rib is arranged to be situated downstream in the direction of air flow from or in phase with the forward end in the direction of air flow of another rib that is the nearest and downstream in the direction of air flow.

10. The apparatus according to claim 7, wherein a suction port of the suction duct is arranged between a surface potential sensor that measures a surface potential of the photoconductor and the magnet roller.

11. The apparatus according to claim 7, wherein a suction port of the suction duct is opened toward the collection roller.

12. The apparatus according to claim 7, wherein a suction port of the suction duct has a height higher than an upper end of the collection roller in the direction of rotation of the photoconductor.

13. The apparatus according to claim 7, wherein a surface potential sensor that measures surface potential of the photoconductor is installed at a site where a suction force in the suction duct is greater than a threshold value.

14. The apparatus according to claim 7, wherein a surface potential sensor that measures surface potential of the photoconductor is installed at a position other than a site where a suction force in the suction duct is smaller than a threshold value.

15. A floating developer collection method for a developing unit comprising:

providing a suction duct that sucks air, downstream from a magnet roller that applies a developer to a photoconductor while rotating, in a direction of rotation of the photoconductor;

arranging ribs for adjusting an air flow within the suction duct in such a manner that a width of an air flow passage formed by a rear end in a direction of air flow and a forward end of the nearest rib in the direction of air flow is narrowed from a rib installed upstream in the direction of air flow toward a rib installed downstream; and collecting a floating developer by the suction duct using a negative pressure.

16. The method according to claim 15, wherein the rear end in the direction of air flow of one rib is arranged to be situated downstream in the direction of air flow from or in phase with the forward end in the direction of air flow of another rib that is the nearest and downstream in the direction of air flow.

17. A floating developer collection method comprising:

providing a suction duct that sucks air, downstream from a magnet roller that applies a developer to a photoconductor while rotating, in a direction of rotation of the photoconductor, and upstream of a surface potential sensor that measures surface potential of the photoconductor;

arranging ribs for adjusting an air flow within the suction duct in such a manner that a width of an air flow passage formed by a rear end in a direction of air flow and a forward end of a nearest rib in the direction of air flow is narrowed from a rib installed upstream in the direction of air flow toward a rib installed downstream; and collecting a floating developer by the suction duct using a negative pressure.

18. The method according to claim 17, wherein the rear end in the direction of air flow of one rib is arranged to be situated downstream in the direction of air flow from or in phase with the forward end in the direction of air flow of another rib that is the nearest and downstream in the direction of air flow.

19. The method according to claim 17, wherein the surface potential sensor that measures surface potential of the photoconductor is installed at a site where a suction force in the suction duct is greater than a threshold value.

20. The method according to claim 17, wherein the surface potential sensor that measures surface potential of the photoconductor is installed at a position other than a site where a suction force in the suction duct is smaller than a threshold value.

* * * * *